US011432657B1

(12) United States Patent
Malinowski et al.

(10) Patent No.: US 11,432,657 B1
(45) Date of Patent: Sep. 6, 2022

(54) FURNITURE WITH EXTENDABLE CONSOLE

(71) Applicant: Raffel Systems, LLC, Germantown, WI (US)

(72) Inventors: Jeff Malinowski, Slinger, WI (US); Bailey Schuetz, Germantown, WI (US)

(73) Assignee: Raffel Systems, LLC, Germantown, WI (US)

( * ) Notice: Subject to any disclaimer, the term of this patent is extended or adjusted under 35 U.S.C. 154(b) by 0 days.

(21) Appl. No.: 17/211,322

(22) Filed: Mar. 24, 2021

(51) Int. Cl.
*A47C 17/04* (2006.01)
*A47C 17/86* (2006.01)
*A47C 7/62* (2006.01)

(52) U.S. Cl.
CPC ..... *A47C 17/04* (2013.01); *A47C 17/86* (2013.01); *A47C 7/624* (2018.08)

(58) Field of Classification Search
CPC ..... A47C 17/04; A47C 17/86; A47C 7/624
USPC ..... 297/118
See application file for complete search history.

(56) References Cited

U.S. PATENT DOCUMENTS 1,063,809 A * 6/1913 Lawson ..... A47C 7/024 297/233
4,555,135 A * 11/1985 Freeland ..... B60N 2/3086 297/105
4,765,678 A * 8/1988 Huang ..... A47C 13/005 297/236
8,936,306 B2 * 1/2015 Liu ..... A47C 11/00 297/144
2018/0153309 A1 * 6/2018 Adams ..... A47C 17/86
2021/0107409 A1 * 4/2021 Salvia, III ..... B60R 7/04

FOREIGN PATENT DOCUMENTS

CN 210540141 5/2020

* cited by examiner

*Primary Examiner* — Mark R Wendell
(74) *Attorney, Agent, or Firm* — Casimir Jones, S.C.; Brian F. Bradley

(57) ABSTRACT

A piece of furniture including a frame with a seat portion, and a console assembly at least partially received within the seat portion of the frame. The console assembly is movable along an axis between a retracted position and an extended position.

22 Claims, 5 Drawing Sheets

FURNITURE WITH EXTENDABLE CONSOLE

TECHNICAL FIELD

The present disclosure relates to furniture, and more particularly to motion furniture.

BACKGROUND

Some conventional couches include a back portion that manually folds down to provide a table-like surface for an occupant of the couch to use while sitting. However, the folding back portion does not include space for any storage. In addition, when folded down, the conventional folding back portion is unstable and not always level.

SUMMARY

The disclosure provides, in one aspect, a piece of furniture including a frame with a seat portion, and a console assembly at least partially received within the seat portion of the frame. The console assembly is movable along an axis between a retracted position and an extended position.

The disclosure provides, in another aspect, a couch including a frame and a console assembly positioned within the frame. The console assembly including a motor, a container, and a linkage positioned between the motor and the container. The container includes a cavity at least partially defined by a cover. The console assembly moves between a retracted position and an extended position in response to operation of the motor. When the console assembly is in the retracted position, a seat cushion is positioned on the cover, and when the console assembly is in the extended position, the cover is movable between a closed position and an open position in which the cavity is exposed.

Other aspects of the disclosure will become apparent by consideration of the detailed description and accompanying drawings.

Before any embodiments are explained in detail, it is to be understood that the invention is not limited in its application to the details of construction and the arrangement of components set forth in the following description or illustrated in the following drawings. The invention is capable of other embodiments and of being practices or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

Figure 1:
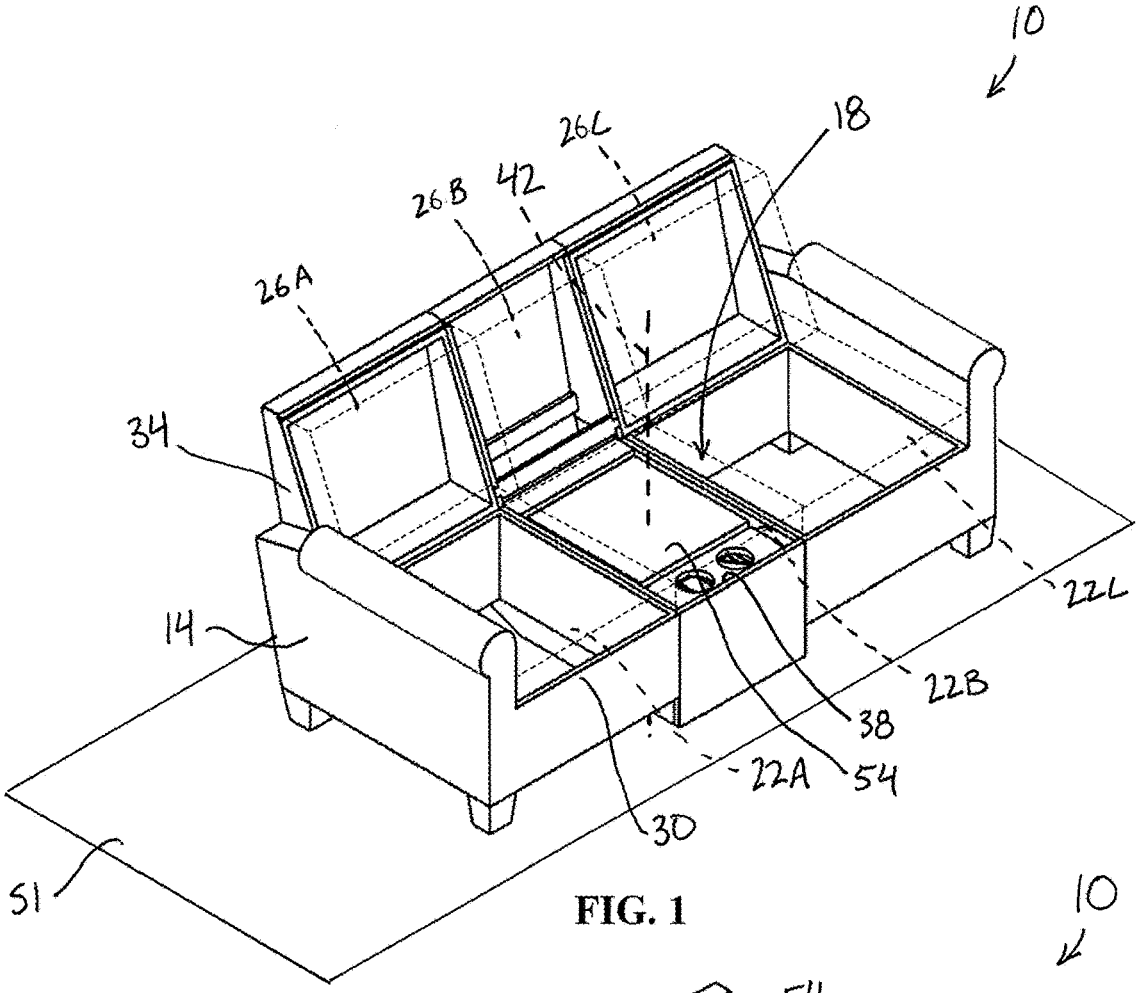
FIG. 1 is a perspective view of a couch with a console assembly shown in a retracted position.

With reference to FIG. 1, a piece of furniture 10 is illustrated with a frame 14 and an extendable console assembly 18. In the illustrated embodiment, the piece of furniture is a couch 10. In other embodiments, the piece of furniture is a sofa, loveseat, ottoman, or other similar pieces of furniture. The couch 10 is supported on a surface S1 (e.g., a floor). In the illustrated embodiment, and for the description herein the surface S1 is planar and horizontal. In other words, the surface S1 is the bottom-most plane defined by the couch 10.

The couch 10 of FIG. 1 is illustrated with a plurality of cushions 22A-22C and 26A-26C shown transparently with dashed lines. In particular, the couch 10 in the illustrated embodiment includes three seat cushions 22A, 22B, 22C and three back cushions 26A, 26B, 26C. The middle back cushion 26B is positioned between the other two back cushions 26A, 26C, and the middle seat cushion 22B is positioned between the other two seat cushions 22A, 22C. In the illustrated embodiment, the console assembly 18 is positioned beneath the middle seat cushion 22B. In other words, the console assembly 18 is positioned vertically between the middle seat cushion 22B and the surface S1 upon which the couch 10 supported.

With continued reference to FIG. 1, the frame 14 includes a seat portion 30 and a back portion 34. The seat portion 30 of the frame 14 is supported on the surface S1 and the back portion 34 is coupled to the seat portion 30. In some embodiments, the frame 14 is made from a wood material (e.g., a plywood). The back portion 34 of the frame 14 is configured to support back cushions 26A-26C. Likewise, the seat portion 30 of the frame 14 is configured to support seat cushions 22A-22C.

With continued reference to FIG. 1, the console assembly 18 is at least partially received within the seat portion 30 of the frame 14. In the illustrated embodiment, the seat portion 30 includes a cavity 38 in which to receive the console assembly 18, and the cavity 38 is positioned beneath the middle seat cushion 22B.

Figure 2:
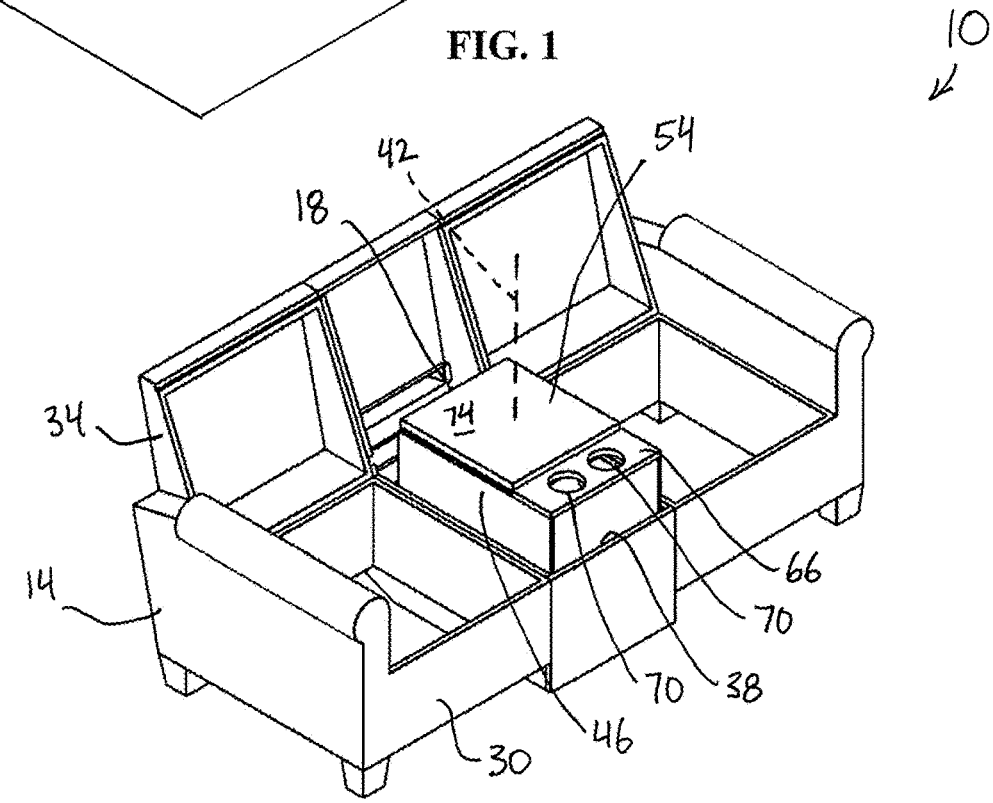
FIG. 2 is a perspective view of the couch of FIG. 1 with the console assembly shown in an extended position.

With reference to FIGS. 1 and 2, the console assembly 18 is movable along an axis 42 between a retracted position (FIG. 1) and an extended position (FIG. 2). The middle seat cushion 22B is positioned on top of the console assembly 18 when the console assembly 18 is in the retracted position. In other words, the middle seat cushion 22B is positioned between the seat cushions 22A, 22C when the console assembly 18 is in the retracted position, retracted within the cavity 38. In some embodiments, the middle back cushion 26B abuts the middle seat cushion 22B when the console assembly 18 is in the retracted position. In the illustrated embodiment, the seat cushions 22A, 22C, 26A, 26B, 26C remain in place as the console assembly 18 moves between the retracted position and the extended position. In other words, the seat cushions 22A, 22C remain undisturbed and therefore can continuously support an occupant while the console assembly 18 moves between the retracted and extended positions.

With continued reference to FIG. 2, the console assembly 18 is configured to extend from the seat portion 30 of the frame 14. In the illustrated embodiment, the surface S1 is horizontal and the axis 42 is vertical. In other words, the axis 42 intersects the surface S1 and in the illustrated embodiment, the axis 42 is perpendicular to the surface S1. The axis 42 extends through the middle seat cushion 22B when the console assembly 18 is in the retracted position of FIG. 1. In the illustrated embodiment, the axis 42 does not intersect the back portion 34 of the frame 14 and the axis 42 does not intersect any back cushions 26A-26C.

Figure 3:
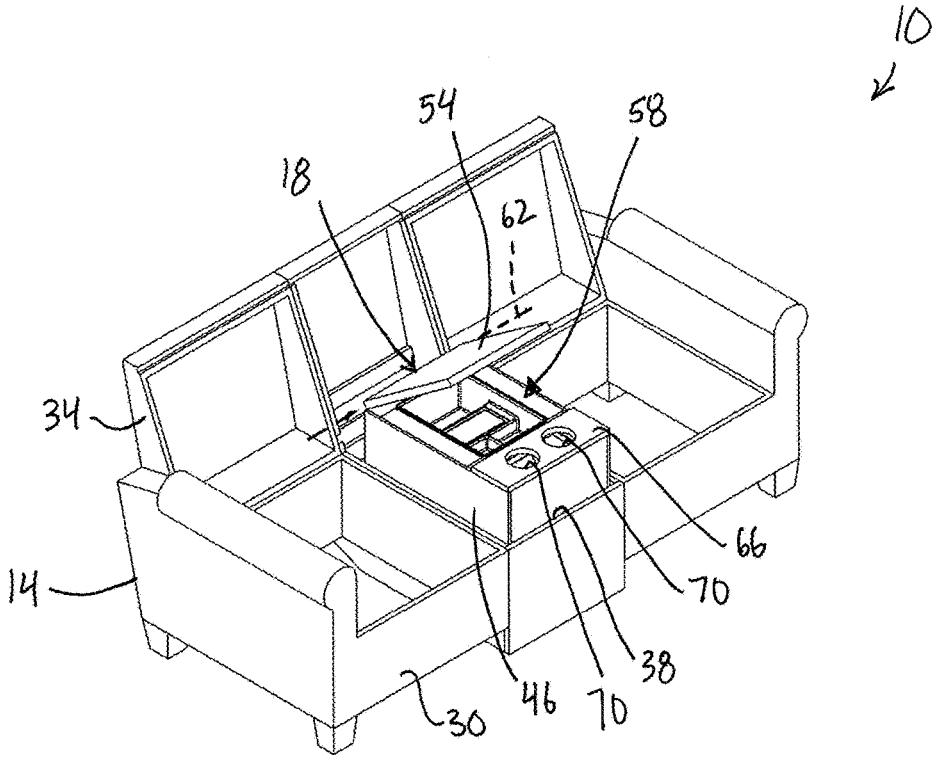
FIG. 3 is a perspective view of the couch of FIG. 1 with the console assembly shown in an extended position and with a cover open to access a storage cavity.
Figure 4:
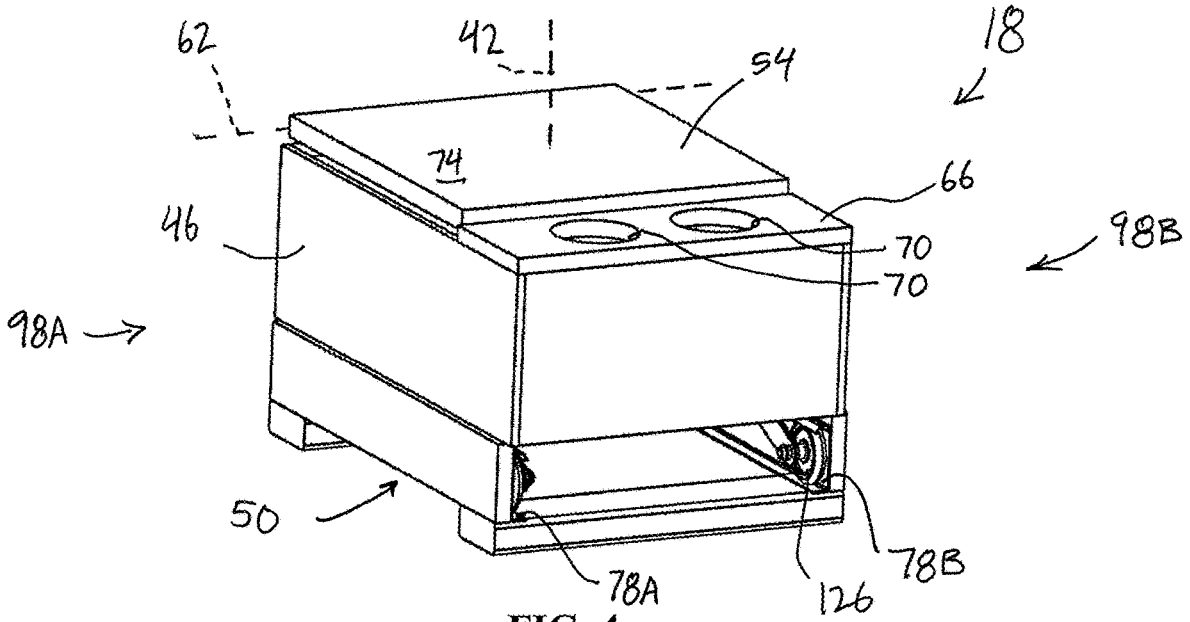
FIG. 4 is a perspective view of the console assembly of FIG. 1.

With reference to FIGS. 3 and 4, the console assembly 18 includes a container 46 and an extension assembly 50 coupled to the container 46. The extension assembly 50 is configured to raise and lower the container 46 along the axis 42 as the console assembly 18 moves between the retracted and extended position. The container 46 includes a cover 54 and a storage cavity 58 at least partially defined by the cover 54. The cover 54 is movable between a closed position (FIG. 2) and an open position (FIG. 3). In the illustrated embodiment, the cover 54 is pivotable about an axis 62, which is parallel to the surface S1. In some embodiments, the storage cavity 58 is configured as a storage area with an organizer. In some embodiments, the storage cavity 58 may include electrical outlets, electrical chargers, ambient lighting (e.g., one or more light emitting diodes (LED), disinfecting light (e.g., ultraviolet (UV)-C lighting), compartments, controls, etc. When the console assembly 18 is in the retracted position (FIG. 1), the seat cushion 22B is positioned on the cover 54. As such, the storage cavity 58 provides a hidden storage compartment within the couch 10 when the console assembly 18 is retracted. When the console assembly 18 is in the extended position (FIG. 2), the cover 54 is movable between the closed position (FIG. 2) and the open position (FIG. 3). When the cover 54 is in the open position (FIG. 3), the storage cavity 58 is exposed and accessible by a user.

The container 46 also includes a panel 66 with apertures 70 formed therein. In some embodiments, the apertures 70 are configured to receive a beverage cup holder. In particular, the apertures 70 are configured in some embodiments to receive illuminated beverage cup holders with integrated user controls.

With continued reference to FIG. 4, the cover 54 includes a planar upper surface 74. The planar surface 74 is orthogonal to the axis 42 when the console assembly 18 is in the retracted position (FIG. 1) and when the console assembly 18 is in the extended position (FIG. 2). In other words, the planar surface 74 remains orthogonal to the axis 42 (and parallel to the surface S1 on which the couch 10 is supported) in both the retracted and extended position. Therefore, the planar surface 74 provides a stable, flat, table-top like surface upon which articles can be placed. The planar surface 74 is an improvement over conventional surfaces that do not fold down flat from a couch back and create unstable surfaces.

Figure 5:
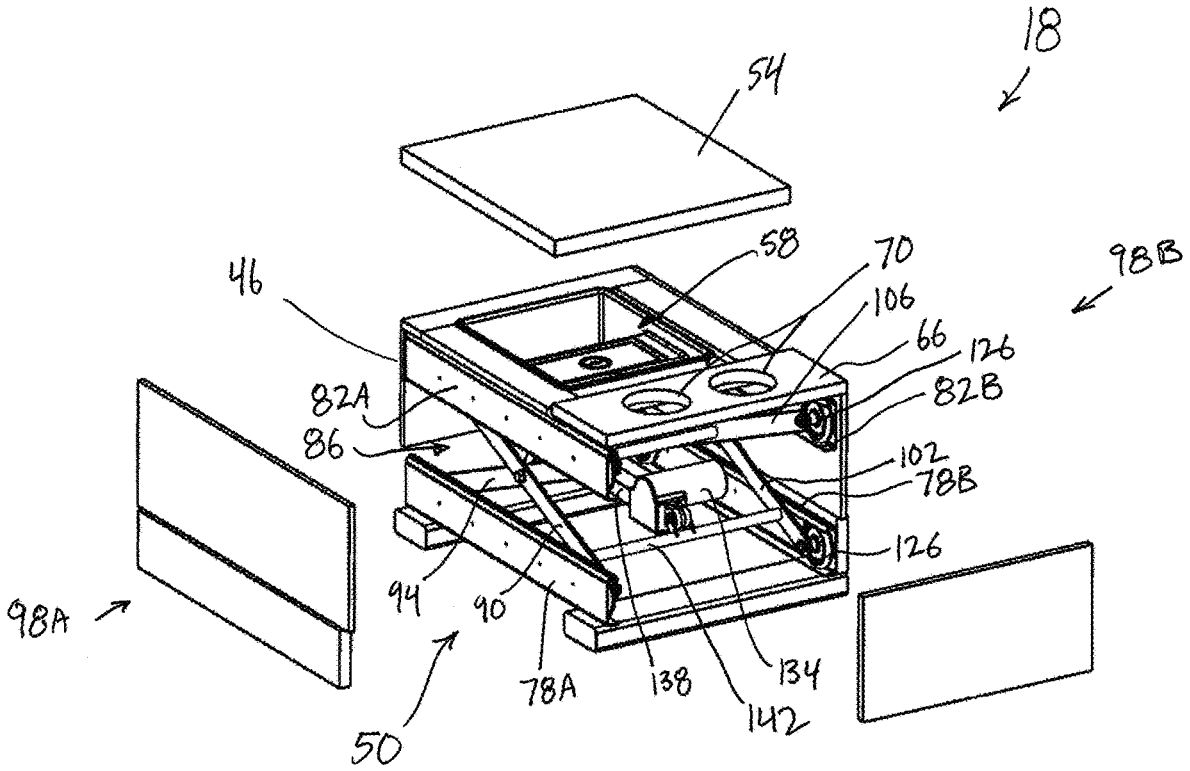
FIG. 5 is an exploded view of the console assembly of FIG. 4.

With continued reference to FIGS. 4 and 5, the extension assembly 50 includes a first base rail 78A, a second base rail 78B, a first top rail 82A, and a second top rail 82B. The base rails 78A, 78B are coupled to the seat portion 30 of the frame 14. The top rails 82A, 82B are coupled to the container 46. The extension assembly 50 also includes a linkage 86 that is coupled between the base rails 78A, 78B and the top rails 82A, 82B.

Figure 6A:
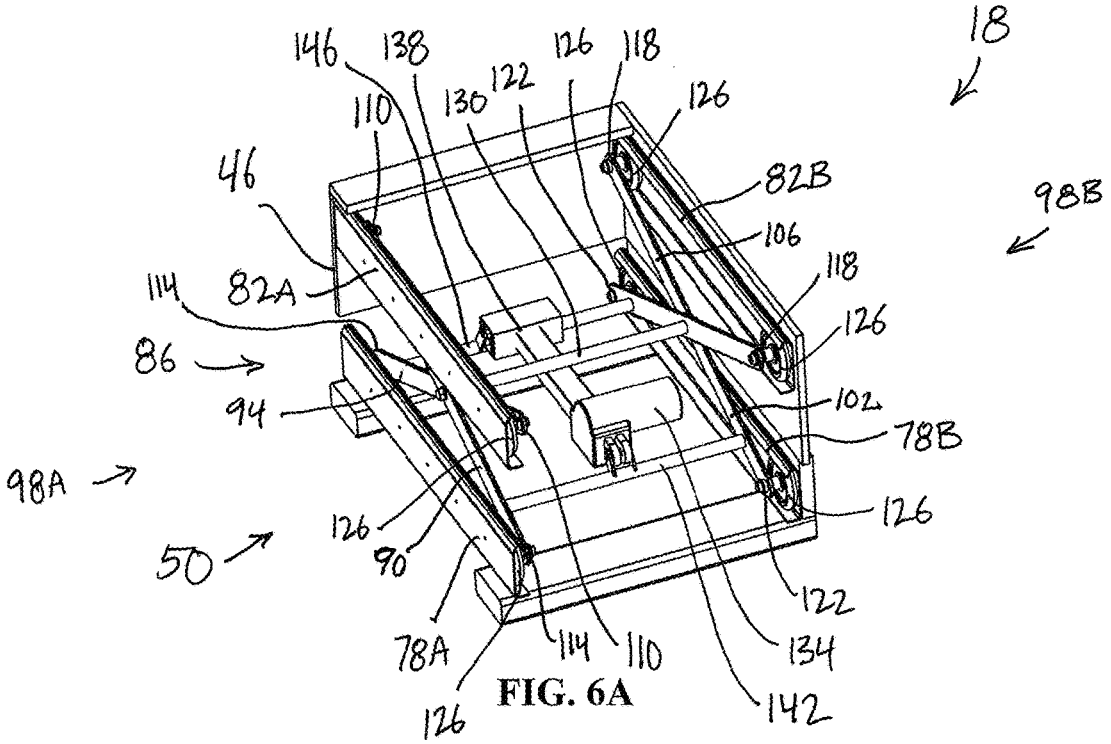
FIG. 6A is a partial tear-away view of the console assembly of FIG. 4 in the retracted position.

With reference to FIG. 6A, the linkage 86 includes a first leg 90 and a second leg 94 on a first side 98A of the container 46 and a third leg 102 and a fourth leg 106 on a second side 98B of the container 46 (opposite the first side 98A). The first leg 90 and the second leg 94 each have a first leg end 110 coupled to the first top rail 82A and a second leg end 114 coupled to the first base rail 78A. Likewise, the third leg 102 and the fourth leg 106 each have a first leg end 118 coupled to the second top rail 82B and a second leg end 122 coupled to the second base rail 78B. In the illustrated embodiment, the leg ends 110, 114, 118, 122 each include a wheel 126 (e.g., a caster wheel) that is slidably received within the rails 78A, 78B, 82A, 82B. In other words, the leg ends 110, 114, 118, 122 are slidable with respect to the corresponding top and base rails 78A, 78B, 82A, 82B. For example, the first leg end 110 of the first leg 90 is slidably received within the first top rail 82A and the second leg end 114 of the first leg 90 is slidably received within the first base rail 78A.

Figure 6B:
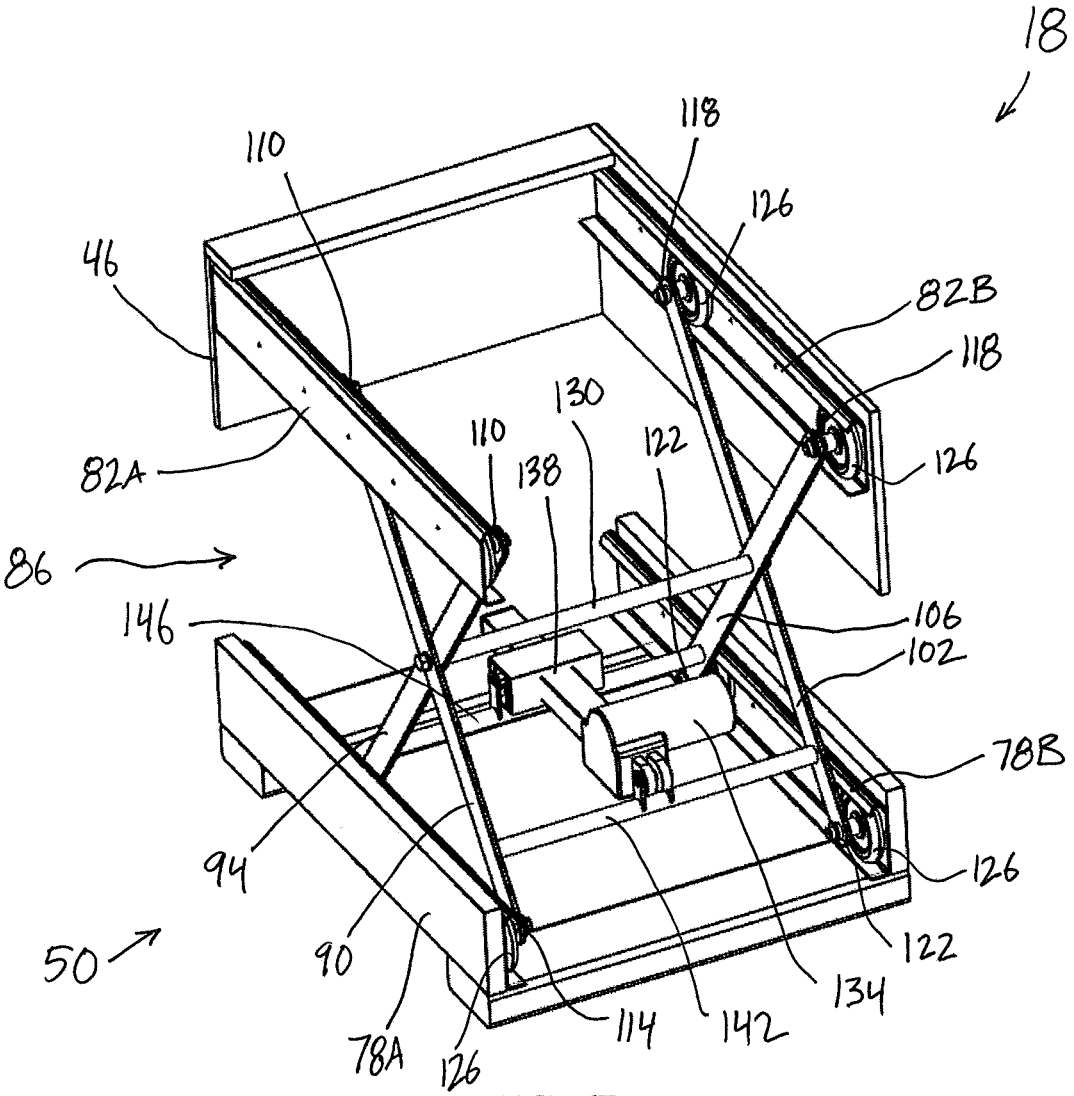
FIG. 6B is a partial tear-away view of the console assembly of FIG. 4 in the extended position.

With reference to FIG. 6B, the linkage 86 also includes a center crossbar 130. Each of the first leg 90 and the second leg 94 are pivotably coupled to the center crossbar 130 at the first side 98A. Likewise, each of the third leg 102 and the fourth leg 106 are pivotably coupled to the center crossbar 130 at the second side 98B. In the illustrated embodiment, the first leg 90 and the second leg 94 form an X-shape (i.e., positioned in an X-shape) and the center crossbar 130 is coupled to legs 90, 94 where the legs 90, 94 overlap. Likewise, the third leg 102 and the fourth leg 106 form an X-shape (i.e., positioned in an X-shaped) and the center crossbar 130 is coupled to the legs 102, 106 where the legs 102, 106 overlap.

With reference to FIGS. 6A and 6B, the extension assembly 50 includes an electric motor 134 and a drive 138 that is coupled between the electric motor 134 and the linkage 86. In other words, the linkage 86 is positioned between the electric motor 134 and the container 46. As such, the console assembly 18 moves between the retracted position (FIG. 6A) and the extended position (FIG. 6B) in response to operation of the electric motor 134. In the illustrated embodiment, the linkage 86 also includes a first offset crossbar 142 and a second offset crossbar 146. The first offset crossbar 142 is coupled between the first leg 90 and the third leg 102 and the second offset crossbar 146 is coupled between the second leg 94 and the fourth leg 106. The electric motor 134 is coupled to the first offset crossbar 142 and the drive 138 is coupled to the second offset crossbar 146.

In the illustrated embodiment, the drive 138 is a threaded nut slidable along a screw that is rotated by the electric motor 134. In other words, the drive 138 in the illustrated embodiment is a screw drive actuator. In other embodiments, the drive 138 may be any suitable mechanical coupling between the electric motor 134 and the linkage 86. For example, in some embodiments, the drive is a rack and pinion arrangement where linear motion of the rack is driven by the electric motor rotationally driving the pinion. In other embodiments, the drive includes a multi screw direct lift or a spring-loaded mechanism. In other embodiments, the drive is pneumatic. In some embodiments, the motor and/or the drive includes a mechanical stop, a brake assembly to secure the container position, and/or a clutch for preventing back driving of the motor.

With continued reference to FIGS. 6A and 6B, when the console assembly 18 is in the retracted position (FIGS. 1 and 6A), the first offset crossbar 142 and the second offset crossbar 146 are positioned apart. Activation of the electric motor 134 causes the drive 138 to move relative to the electric motor 134, and as a result, the first offset crossbar 142 and the second offset crossbar 146 move closer together as the console assembly 18 moves along the axis 42 to the extended position (FIGS. 2 and 6B). In some embodiments, user input controls for the electric motor 134 specifically and the console assembly 18 generally is integrated into the couch 10 (e.g., a mounted electrical switch). For example, in some embodiments controls for the console assembly 18 are integrated into the cover 54. In other embodiments, the user input controls may be provided on a user device via wireless communication (e.g., a remote control, a cell phone, etc.).

In operation, the couch 10 is utilized in a first configuration (with the console assembly 18 in the retracted position) in which at least one occupant may be supported on the couch. In the illustrated embodiment, the couch 10 is configured with three seat cushions 22A-22C when in the first configuration (i.e., a full-length couch). When a user desires to extend the console assembly 18, the middle seat cushion 22B is removed and the electric motor 134 is activated to move the console assembly 18 along the axis 42. In the illustrated embodiment, the couch 10 is configured with two seat cushions 22A, 22C when in the second configuration (i.e., a love seat with a center counsel extended). In some embodiments, the middle seat cushion 22B is detachable from the couch 10 and is set aside when the console assembly 18 is extended. In other embodiments, the middle seat cushion 22B is received within the frame 14 when the console assembly 18 is extended. For example, the middle seat cushion 22B may slide forward and down into the frame 14 via tracks and sliders such that the middle seat cushion 22B is stored while the console assembly 18 is extended. In the illustrated embodiment, there are no pinch points that are created by the extension and retraction of the console assembly 18.

Figure 7:
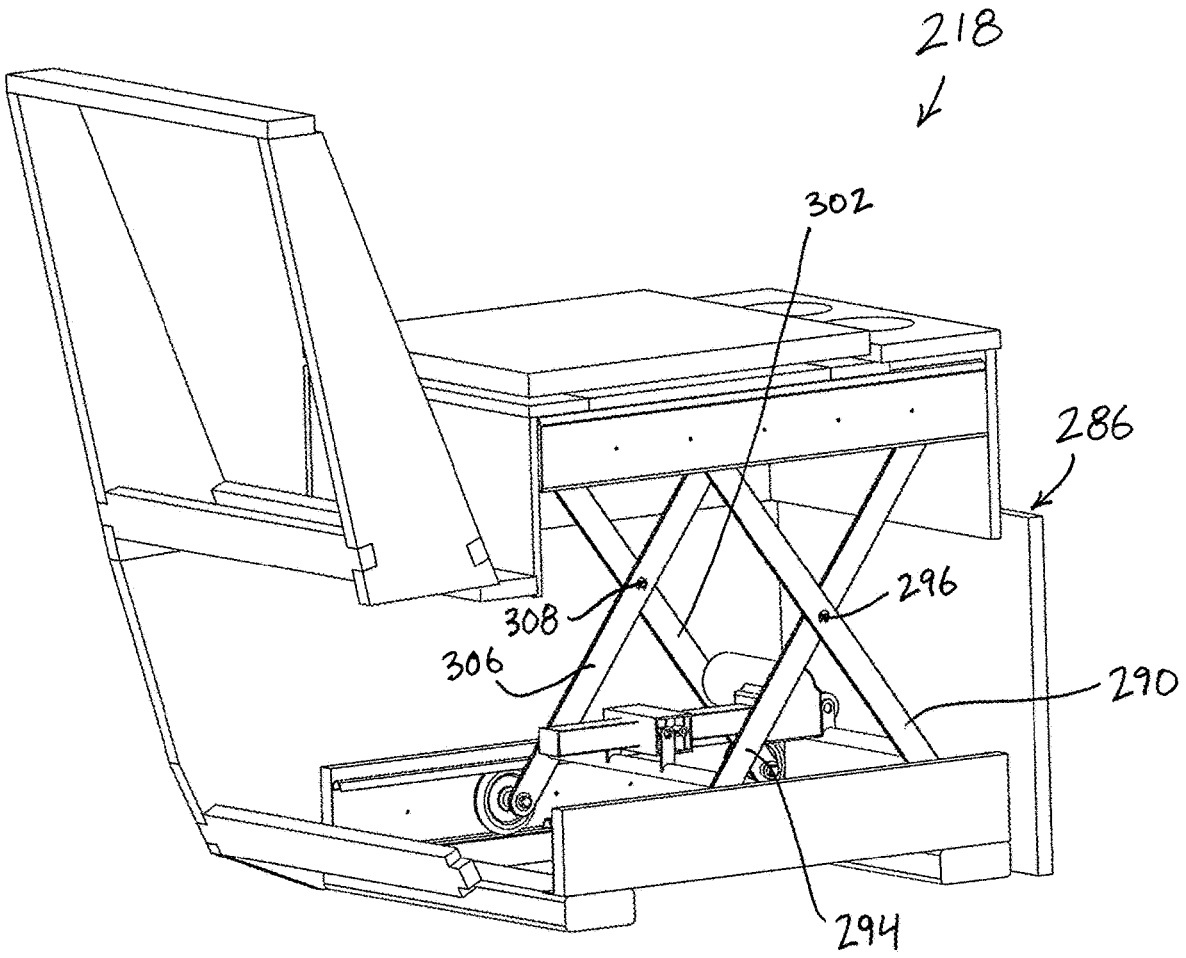
FIG. 7 is a partial tear-away view of an alternative console assembly with no center crossbar.

With reference to FIG. 7, an alternative console assembly 218 is illustrated. The console assembly 218 is similar to the console assembly 18 and the same reference numerals are utilized to reference the similar components with only the differences described in detail herein. The console assembly 218 includes a linkage 286 with a first leg 290, a second leg 294, a third leg 302, and a fourth leg 306. The linkage 286 does not include a center crossbar (i.e., like the center crossbar 130 of the console assembly 18). The first leg 290 is pivotably coupled to the second leg 294 at a pivot 296. Likewise, the third leg 302 is pivotably coupled to the fourth leg 306 at a pivot 308. In some embodiments, the pivots 296, 308 include bearings. In the illustrated embodiment, the first leg 290 and the second leg 294 form an X-shape (i.e., positioned in an X-shape) and the pivot 296 is positioned where the legs 290, 294 overlap. Likewise, the third leg 302 and the fourth leg 306 form an X-shape (i.e., positioned in an X-shaped) and the pivot 308 is positioned where the legs 302, 306 overlap.

Various features and advantages are set forth in the following claims.

What is claimed is:

1. A piece of furniture comprising:

a frame including a seat portion configured to support a seat cushion; and a console assembly at least partially received within the seat portion of the frame, wherein the console assembly is movable along an axis between a retracted position and an extended position; and wherein the seat cushion is positioned on the console assembly and the seat cushion at least partially covers the console assembly when the console assembly is in the retracted position.

2. The piece of furniture of claim 1, wherein the seat cushion is a first seat cushion and wherein the seat portion of the frame is configured to support a second seat cushion and a third seat cushion, and wherein the second seat cushion and the third seat cushion remain in place as the console assembly moves between the retracted position and the extended position.

3. The piece of furniture of claim 2, wherein the first seat cushion is positioned between the second seat cushion and the third seat cushion when the console assembly is in the retracted position.

4. The piece of furniture of claim 3, wherein the frame includes a back portion configured to support a first back cushion, a second back cushion, and a third back cushion, the first back cushion positioned between the second back cushion and the third back cushion; and wherein the first back cushion abuts the first seat cushion when the console assembly is in the retracted position.

5. The piece of furniture of claim 4, wherein the first back cushion, the second back cushion, and the third back cushion remain in place relative to the frame as the console assembly moves between the retracted position and the extended position.

6. The piece of furniture of claim 1, wherein the axis is vertical.

7. The piece of furniture of claim 1, wherein the console assembly includes a container and an extension assembly coupled to the container.

8. The piece of furniture of claim 7, wherein the container includes a cover with a planar surface and a cavity at least partially defined by the cover.

9. The piece of furniture of claim 8, wherein the container includes a panel with an aperture formed therein.

10. The piece of furniture of claim 8, wherein the planar surface is orthogonal to the axis when the console assembly is in the retracted position and when the console assembly is in the extended position.

11. The piece of furniture of claim 8, wherein the cover is pivotably movable between a closed position and an open position.

12. The piece of furniture of claim 7, wherein the extension assembly includes a base rail and a top rail, the top rail is coupled to the container, and wherein the extension assembly further includes a linkage coupled between the base rail and the top rail.

13. The piece of furniture of claim 12, wherein the linkage includes a first leg and a second leg and wherein each of the first leg and the second leg include a first end coupled to the top rail and a second end coupled to base rail.

14. The piece of furniture of claim 13, wherein the linkage includes a center cross bar and wherein each of the first leg and the second leg are pivotably coupled to the center cross bar.

15. The piece of furniture of claim 12, wherein the extension assembly includes an electric motor and a drive coupled between the electric motor and the linkage, wherein the console assembly moves between the retracted position and the extended position in response to operation of the electric motor.

16. The piece of furniture of claim 15, wherein the linkage includes a first offset crossbar and a second offset crossbar, and wherein the electric motor is coupled to the first offset crossbar and the drive is coupled to the second offset crossbar.

17. The piece of furniture of claim 1, wherein the console assembly extends from the seat portion of the frame in the extended position.

18. A couch comprising:

a frame;

a console assembly positioned within the frame, the console assembly including a motor, a container, and a linkage positioned between the motor and the container, wherein the container includes a cavity at least partially defined by a cover;

wherein the console assembly moves between a retracted position and an extended position in response to operation of the motor;

wherein when the console assembly is in the retracted position, a seat cushion is positioned on and at least partially covering the cover, and wherein when the console assembly is in the extended position, the cover is movable between a closed position and an open position in which the cavity is exposed.

19. The couch of claim 18, wherein the linkage includes a first leg pivotably coupled to a center crossbar and a second leg pivotably coupled to the center crossbar.

20. The couch of claim 19, wherein a first end of the first leg is slidably received within a top rail coupled to the container, and wherein a second end of the first leg is slidably received within a base rail coupled to the frame.

21. The couch of claim 18, wherein the console assembly moves along a vertical axis when moving between the retracted position and the extended position.

22. The couch of claim 18, wherein the seat cushion is a first seat cushion and wherein the couch further includes a second seat cushion, a third seat cushion, a first back cushion, a second back cushion, and a third back cushion;

wherein the first seat cushion is positioned between the second seat cushion and the third seat cushion when the console assembly is in the retracted position;

wherein the first back cushion is positioned between the second back cushion and the third back cushion; and wherein the first back cushion abuts the first seat cushion when the console assembly is in the retracted position; and wherein the second seat cushion, the third seat cushion remain, the first back cushion, the second back cushion, and the third back cushion remain in place relative to the frame as the console assembly moves between the retracted position and the extended position.

* * * * *